US005891375A

United States Patent [19]

Stall et al.

[11] Patent Number: 5,891,375

[45] Date of Patent: Apr. 6, 1999

[54] PROCESSES FOR PRECIPITATING TERTIARY AMINE OXIDE CELLULOSE SOLUTIONS CONTAINING ESTERS AND PRODUCTS MADE THEREFROM

[75] Inventors: Alan David Stall, Naperville, Ill.; Albin F. Turbak, Sandy Springs, Ga.

[73] Assignee: Alfacel s.a., Madrid, Spain

[21] Appl. No.: 899,425

[22] Filed: Jul. 24, 1997

[51] Int. Cl.[6] ..... D01F 1/10; D01F 2/02

[52] U.S. Cl. ..... 264/187; 264/211

[58] Field of Search ..... 264/187, 203, 264/211

[56] References Cited

U.S. PATENT DOCUMENTS

| | | | |
|---|---|---|---|
| 2,179,181 | 11/1939 | Graenacher et al. | 106/200.3 |
| 3,447,939 | 6/1969 | Johnson | 106/124.7 |
| 3,508,941 | 4/1970 | Johnson | 106/141.1 |
| 4,142,913 | 3/1979 | McCorsley, III et al. | 106/200.3 |
| 4,144,080 | 3/1979 | McCorsley, III | 106/200.3 |
| 4,145,532 | 3/1979 | Franks et al. | 536/56 |
| 4,426,288 | 1/1984 | Miinte | 210/242.3 |
| 5,358,765 | 10/1994 | Markulin | 428/34.8 |
| 5,409,532 | 4/1995 | Astegger et al. | 106/200.3 X |

OTHER PUBLICATIONS

Chanzy et al. "Swelling and Dissolution of Cellulose in Amine Oxide/Water Systems," *Journal of Applied Polymer Science: Applied Polymer Symposium,* 37:239–259 (1983).

Turbak et al., "Cellulose solvents," *Chemtech,* 10:51–57 (Jan., 1980).

Turbak, A.F., "Recent developments in cellulose solvent systems," *TAPPI Journal,* 67(1):94–96 (Jan., 1984).

*Primary Examiner*—Leo B. Tentoni

*Attorney, Agent, or Firm*—Marshall, O'Toole, Gerstein, Murray & Borun

[57] ABSTRACT

The invention provides improvements in processes for film and fiber production involving precipitating cellulose from tertiary amine oxide solutions wherein an ester is incorporated into the solution in an amount sufficient to slow precipitation of the cellulose during separation of the cellulose from the tertiary amine oxide.

18 Claims, No Drawings

PROCESSES FOR PRECIPITATING TERTIARY AMINE OXIDE CELLULOSE SOLUTIONS CONTAINING ESTERS AND PRODUCTS MADE THEREFROM

BACKGROUND OF THE INVENTION

The present invention relates generally to regenerated cellulose and more specifically to processes for preparing solutions of cellulose in a tertiary amine oxide and for producing shaped articles such as fibers and films.

The use of organic N-oxides such as tertiary amine oxides for dissolving cellulose was first reported by Graenacher and Sallman in U.S. Pat. No. 2,179,181. Subsequently, the specific use of N-Methyl Morpholine-N-Oxide (NMMO) to dissolve cellulose was disclosed by D. L. Johnson in U.S. Pat. No. 3,447,939 and U.S. Pat. No. 3,508,941. These patents disclose the use of NMMO to dissolve cellulose and the production of films and fibers by the precipitation of the dissolved cellulose.

The use of NMMO as a solvent for cellulose and the production of cellulosic fibers and films was also disclosed in McCorsley et al., U.S. Pat. No. 4,142,913 which disclose a process wherein cellulose is mixed with a tertiary amine oxide such as NMMO and a liquid non-solvent containing controlled amounts of water which assists in intimately associating the tertiary amine oxide with the fibers of the cellulose to facilitate absorption of the tertiary amine oxide. The resulting mixture is maintained at a temperature at which the non-solvent and excess water are removed so that the cellulose dissolves in the tertiary amine oxide until a solution is obtained which is suitable for shaping into a cellulosic article such as by spinning or extrusion. The non-solvent can be water or it can be a mixture of water and organic non-solvent with a boiling point below 130° C. including alcohols such as n-propyl alcohol, isopropyl alcohol, butanol or an aprotic liquid such as toluene, morpholine, methyl ethyl ketone or tetrahydrofuran.

McCorsley et al., U.S. Pat. No. 4,144,080 disclose a process wherein a commuted solid precursor of a solution of cellulose in amine oxide such as NMMO is charged to an extrusion apparatus, is heated to a temperature where the amine oxide dissolves the cellulose to form an extrudable solution of cellulose and the resulting solution is extruded through a die to form an extrudate of uniform composition. Franks et al., U.S. Pat. No. 4,145,532 disclose methods of dissolving cellulose in solutions containing water and NMMO. Turbak et al., *Chemtech*, p. 51–57, January, 1980 provide a review of developments in cellulose solvent systems including amine oxides. Turbak subsequently reported cellulose solutions with lithium chloride and dimethylacetamide. These references further describe the potential use of such solutions in the production of new fiber and film products.

Of specific interest to the present application is the disclosure of Johnson, U.S. Pat. No. 3,508,941 which describes the addition of various water soluble and other polymers including polymeric esters such as poly(vinyl acetate), polysaccharides such as gum arabic, and proteins such as gelatin with cellulose and uses dimethyl sulfoxide (DMSO) as an organic co-solvent for the two polymers in the presence of N-methyl-morpholine-N-oxide and other cyclic N-oxides. Nevertheless, U.S. Pat. No. 3,508,941 teaches in its examples use of at least equal amounts of the added polymer to the amount of cellulose and does not disclose use of water as a cosolvent with lowering the water concentration to a point necessary to achieve solubility of the cellulose.

The NMMO process for producing cellulosic fibers and films has become particularly attractive in recent years because of safety and environmental concerns regarding the viscose process traditionally used for production of cellulosic films and fibers. In particular, the use of carbon disulfide in the viscose system has led to a desire for a simple, more ecologically friendly closed loop totally recoverable cellulose solvent system. Use of processes for spinning cellulose from NMMO solutions continues with the manufacture of over 120 million lbs/year of cellulose fibers via the NMMO process in about 1996.

While the NMMO system for production of cellulosic films and fibers provides various benefits over use of the viscose system it is also subject to certain limitations. This is particularly the case with respect to the ability to control the precipitation of the cellulose. In the viscose system, the cellulose is first made into a xanthate derivative by the use of caustic soda and carbon disulfide. This derivative is then spun into a coagulation/regeneration bath containing high salt and low to medium acid so that the cellulose can first be congealed into a gelatinous mass and densified by the salt in a controlled manner. This allows the xanthate solubilizing groups on the cellulose molecules sufficient opportunity to permit alignment and packing of the cellulose into the proper positions to make a good quality product. The longer the regeneration is retarded, the higher is the resulting product quality since more effective stretching and alignment can be obtained in the densifying coagulated system.

In contrast to methods of using the viscose system, the cellulose molecules in tertiary amine oxide processes are not derivatized but are directly dissolved by the action of the tertiary amine oxide. This dissolving takes place over very narrow limits of water content. As may be seen from the graphs published by Franks et al. in U.S. Pat. No. 4,145,532 and also by Chanzy et al. "Swelling and Dissolution of Cellulose in Amine Oxide/Water Systems," *Ninth Cellulose Conference*, State University of New York, Syracuse, N.Y., May 24–27, 1982) there are relatively narrow concentration ranges for dissolving and maintaining cellulose in solution. Beyond these ranges, for example, further addition of water causes very rapid and drastic precipitation of the cellulose out of solution. See also, Turbak, TAPPI *Journal*, Vol. 67., No. 1 pp. 94–96 (1984). Thus, as compared to the viscose process, the ability to control the coagulation and precipitation of cellulose in a tertiary amine oxide process is substantially diminished thus hindering the ability to provide for orderly spinning of a fiber or extrusion of a film. While such rapid and dramatic precipitation is advantageous from the view of getting high spinning speeds, it is disadvantageous with respect to being able to control and improve the nature of the product properties. Accordingly, there exists a need in the art for methods to retard and control the rapid precipitation of the cellulose from NMMO and other tertiary amine oxide solutions in order that better control of molecular structure can be obtained during the coagulation and precipitation of the cellulose molecules.

SUMMARY OF THE INVENTION

The present invention provides improved methods for retarding and controlling the rapid precipitation of cellulose from tertiary amine oxide solutions. Specifically, it has been found that esters selected from the group consisting of mono-, di- and multiple esters added to the NMMO/cellulose solutions can act as buffers to dramatically slow down the precipitation process.

Specifically, the invention provides the use of such esters as additives to cellulose/tertiary amine oxide solutions to retard the rapid precipitation of said cellulose/tertiary amine oxide solutions on spinning or extrusion into water. The invention thus provides improvements in a process for precipitating cellulose from a solution thereof which comprises dissolving cellulose in a solvent for the cellulose containing a tertiary amine oxide and thereafter shaping the solution and separating the cellulose from the tertiary amine oxide, the improvement wherein the solution comprises an ester selected from the group of mono-, di- and multiple esters having less than 10% solubility in water at 25° C. in an amount sufficient to retard precipitation of the cellulose during separation of the cellulose from the tertiary amine oxide.

According to preferred methods, the solution comprises up to 40% by weight cellulose dissolved in a solvent of NMMO containing from about 5% to about 20% water and the ester is present in amounts above 3% by weight based upon the weight of the cellulose. Preferably, the ester is present in solution concentrations of less than 25% or more preferably less than 10% by weight. Alternatively, the ester may be present at levels such as at less than 50% or 25% based on the weight of cellulose present. According to further preferred aspects of the invention the solution comprises from about 8% to about 22% water and even more preferably the solution comprises from about 5% to about 35% cellulose; and from about 2% to about 30% of a di-, tri, and multiple ester having a molecular weight of more than 340 dissolved in a solvent of NMMO/water having from about 8% to about 22% water. According to a further preferred aspect of the invention, the ester is characterized by a molecular weight of less than 100,000. The precipitation preferably takes place in an aqueous system precipitation bath which can be cold or hot water or even steam. According to one preferred aspect, the solution is substantially free of an organic cosolvent for the ester (such as DMSO). The process may be used to provide fibers, films and other materials including sausage casings because of the improved processability of the precipitating cellulose provided by the methods of the invention.

While the tertiary amine oxide can be any of a variety known to the art including N-methylpiperidine-N-oxide; N-methylhomopiperidine oxide; N-dimethylcyclohexylamine oxide; N,N-dimethybenzylamine oxide; N-methylpyrrolidone-oxide the preferred tertiary amine oxide according to the invention is N-methyl morpholine N-oxide (NMMO).

Esters are formed by reaction of an acid with an alcohol the esters useful according to the invention are produced from alcohols having at least two hydroxyl (—OH) groups for possible reaction with monofunctional acids. This includes polyalcohol compounds comprising multiple alcohol groups including glycols, polyoxyether glycols, glycerols, glucose, mannose, galactose and other sugars having up to six hydroxyl groups, sucrose having up to 8 hydroxyl groups, and polymeric sugars such as glucans, mannans and the like having up to three available hydroxyl groups available per monomeric residue. Also included are esters prepared from polyfunctional acids reacted with monofunctional alcohols, as, for example, ester of citric, malonic, tartaric, succinic, maleic acids and the like. Polymeric esters such as linear polyesters formed by the use of difunctional acids such as terephthalic acid with difunctional alcohols are specifically excluded from this application. Preferred esters for use according to the invention include those which limit the amount of free hydroxyl availability which may be accomplished by requiring that at least 25% of the available hydroxyl groups on each alcohol molecule (on average) be substituted with a monofunctional acid to form the desired esters. Also preferred are esters having at least 25% of the multifunctional acid groups reacted with a monofunctional alcohol.

Diffusion or bleeding of ester additives into the coagulating water bath is undesirable because it can create recycle and recovery problems. Accordingly, it is preferred that the acid or alcohol component of the esters used according to the methods of the invention be selected such that the resulting esters have less than 10% solubility in water at 25° C. and are thus more hydrophobic than hydrophilic. Typically, this can be accomplished by choosing the acid component such that the ester is characterized by a molecular weight greater than 340. Generally this means using at least one alcohol having 4 or more carbon atoms per hydroxy (OH) function and acids having at least 4 or more carbons per carboxy (COOH) function as esterifying agents. For example, polyfunctional alcohols would be reacted with at least one acid having at least 4 carbon atoms and polyfunctional acids would be reacted with at least one alcohol having at least 4 carbon atoms. Since esters are quite water insoluble, it is thus possible to utilize esters having a relatively low molecular weight as compared to other species. Thus, glycerol triesters such as glycerol trioleate, and glycerol monooleate diacetate, or ethylene or propylene glycol fatty acid esters can all be used to advantage as additives to change the precipitation rates of cellulose/NMMO solution.

By use of the low solubility esters, the ester additives can remain, in part, in the cellulose product to enhance or alter the cellulose product properties or may remain, in part, in the NMMO and can then be recycled with the NMMO into new cellulose solutions. The esters can thus simplify the NMMO recovery process by modifying the removal of the NMMO from the precipitated cellulose/water mixture. By appropriate selection of the acid and alcohol components of the ester cellulose/NMMO solutions in amounts between 3.0% and 30% based on the weight of NMMO will function to significantly decrease the rate at which coagulating bath will function to disrupt the cellulose/NMMO bonding and thus reduce the undesirable rapid precipitation of the cellulose from solution. Such additives also alter fiber modulus and improve film and sausage casing suppleness and toughness.

Particularly preferred esters include glycerol diesters, di-, tri, and partially hydrolyzed polyvinyl acetate, esterified sucrose esters, lecithin and glycerol triesters including glycerol trioleate, glycerol monooleate diacetate, glycerol monooleate acetate, ethylene and propylene glycol fatty acid esters, polyoxyethylene fatty esters including esterified polyoxyethylene glycol, sorbose, glucose, fructose, sucrose and other sugar fatty esters, glucan, mannan and similar polysugar esters, and wholly and partially substituted polyvinyl esters of acrylic acid, citric acid, itaconic acid, maleic, fumaric, malonic acid, etc. A particularly preferred ester is polyvinyl acetate having at least 25% remaining acetate groups. Those of skill in the art upon considering the disclosure herein would be able to determine the concentration of ester required to be incorporated into the cellulose/tertiary amine oxide solutions in order to prolong and better control the precipitation of cellulose. Nevertheless, it is generally preferred that the ester be present in amounts above 3.0% by weight based on the NMMO.

The solutions used according to the invention may also comprise other ingredients known to be useful in tertiary amine oxide/cellulose solutions. Nevertheless, additives having excessive amounts of free hydroxyl groups are generally detrimental to achieving cellulose solution in the NMMO, all such additives should generally be excluded from incorporation into the solutions, and so esters having at least 25% of its hydroxyl groups being esterified are preferred.

The solutions may optionally incorporate water soluble polymers including carbohydrate polymers such as cellulose and sugar derivative and polyacrylic acid polymers as described in co-owned and copending U.S. Ser. No. 08/899,684 filed Jul. 24, 1997, wherein the disclosure is incorporated herein by reference. Preferred water soluble polymers described therein include polymeric ethers including poly (ethylene oxide), polymers having molecular weights of 100,000 (polyox WRSN-10, Union Carbide), of 900,000 (polyox WSR-1105, Union Carbide), of 4,000,000 (polyox WSR-1105, Union Carbide) and a methyl capped polypropylene oxide polymer having a molecular weight of 50,000. Also incorporated by reference herein is the disclosure of co-owned and copending U.S. Ser. No. 08/899,538 filed Jul. 24, 1997 which describes improved methods for retarding and controlling the rapid precipitation of cellulose from tertiary amine oxide solutions in aqueous hardening baths by reducing the concentration of water therein and preferably increasing the concentration of tertiary amine oxides in the stead of the water therein.

According to a particularly preferred aspect of the invention the solution comprises from about 5% to about 35% cellulose; dissolved in NMMO containing from about 8% to about 20% water; and from about 3.0% to about 30% of an ester having a molecular weight greater than 340 and having at least 25% of the available alcohol (—OH) or acid (COOH) groups esterified.

The methods of the invention provide the opportunity to more effectively control the precipitation of cellulose from systems using solutions of cellulose and tertiary amine oxides. The greater control in precipitation afforded by practice of the methods of the invention provides improvements in methods for precipitation of cellulose to form fibers as well as to form films. The presence of any residual ester left in the final cellulose product may also have a beneficial effect on final product properties.

DETAILED DESCRIPTION

The present invention provides improved methods for slowing and controlling the rapid precipitation of cellulose from solutions of tertiary amine oxides generally and NMMO solutions in particular. Specifically, it has been found that selected di-, tri, and multiple esters added to the NMMO cellulose solutions can act as buffers to dramatically retard the precipitation process. While the exact mechanism by which these compounds act in a beneficial manner is not known, it is believed that these materials might intercept or form a barrier to the incoming water molecules and tie them up for a short period so that they cannot rapidly upset the critical balance of NMMO/water/cellulose ratio needed to keep the cellulose molecules in solution.

The methods of the invention thus provide an important improvement in processing of tertiary amine oxide/cellulose solutions and their conversion into fibers, films, sausage casings and other formed goods. By using this technology, not only can the present products be improved, but totally new product properties can be achieved due to the inclusion of these described additives in the resulting products.

Other aspects and advantages of the present invention will be understood upon consideration of the following illustrative and comparative examples.

EXAMPLE 1

According to this example, a 10% solution of cellulose is prepared in N-methyl morpholine-N-oxide [NMMO] according to methods known in the art such as described in various U.S. Pat. Nos. including 3,447,939; 4,145,532 and 4,426,288, except that the NMMO is first premixed with the desired ester additive before the addition of the cellulose and subsequent removal of excess water to form the cellulose solution. Specifically 10 parts of cellulose is added to 100 parts of tetrahydrofuran to which was added 20 parts of water, 76 parts of NMMO and 3 parts of diacetylated glycerol coconut oil ester (MYVACET). The mixture is placed in a sigma blade high torque mixer under vacuum. The mixing system is heated up to no more than 120° C. while vacuum is continued and excess water is removed. (Safety note: 120° C. is chosen since NMMO is known to explode violently at, or above, 140° C.) When the water level in the mixture reaches about 15% of the weight of the NMMO, the cellulose goes into solution. This then gives a solution containing approximately 10% by weight of cellulose, 3% by weight of MYVACET dissolved in 76% of NMMO containing 11% of water.

The cellulose solution is then pumped to a screw feeder extruder, deareated and extruded into the desired shape into an aqueous system precipitation bath which can be either cold or warm water or even steam. Upon extrusion into the precipitation bath the water concentration of the cellulose solution is increased and the cellulose precipitates out of solution. Regardless of the nature of the aqueous precipitation system, incorporation of the di-, tri, and multiple ester component into the solution decreases the rate of precipitation of the cellulose. In this manner the extrudate can be subjected to more stretch and congealing than is possible if the additive is absent.

If the above bath is spun into fibers, the fibers having the added time for stretching will be at least 15% stronger than controls run without the additive. If the above NMMO solution is spun into a film, the film, if properly stretched, will have at least 15% more strength in both the machine and transverse direction. The improvement in properties is noted in fibers, films and sausage casings.

EXAMPLE 2

According to this example, the method of Example 1 is repeated but wherein 4.0 parts of glycerol monooleate (MYVEROL) is added in place of the 3.0 parts of MYVACET. The solution so prepared exhibits improved control of precipitation and gives fibers, films and sausage casings that are more supple, tougher and more elongatable.

EXAMPLE 3

According to this example, the method of Example 2 is repeated using 4.0 parts of 70% hydrolyzed polyvinyl acetate of D.P.=1,000 in place of the glycerol dioleate monoacetate. Similar improvements in precipitation delay and product improvement over the use of polyethylene terephthalate are noted.

EXAMPLE 4

According to this example, the method of Example 1 is repeated except that 5.0 parts of cellulose acetate having a degree of polymerization of 250 is used in place of the 3 parts of MYVACET. Corresponding retardation of precipitation and product strength, toughness and elongation improvements are noted.

EXAMPLE 5

According to this example, the methods of Example 1 is repeated except that 10 parts of dioctyl sebacate is substituted for the 3 parts of MYVACET. Corresponding retardation and improved product performance is noted.

EXAMPLE 6

According to this example, the methods of Example 1 is repeated except that 12 parts of propylene glycol dilaurate is used in place of the 2 parts of PET. Corresponding retardation and improved product properties are exhibited.

EXAMPLE 7

According to this example, the method of Example 6 is repeated with the difference that 6 parts of polyoxyethylene dilaurate is used in place of 12 parts of propylene glycol dilaurate. Corresponding improved product properties are found.

EXAMPLE 8

According to this example, 15 parts of cellulose are mixed with 75 parts of NMMO monohydrate and 10 parts of dioctyl succinate. After heating to 120° C., solution occurs. This solution on spinning exhibits a significant decrease in the speed of precipitation and the products have improved physical properties with regard to strength, burst and elongation.

EXAMPLE 9

According to this example, the method of Example 1 is repeated with the exception that 9 parts of fully esterified sucrose (Olestra™) is used in place of the 3 parts of MYVACET. Fibers and films spun from this system are expected to have improved suppleness and toughness as compared to unmodified products.

EXAMPLE 10

According to this example, the method of Example 2 is repeated with the exception that 6.0 parts of peanut oil is used in place of the glycerololeate. This solution exhibits significant advantages in spinning and other product improvements.

EXAMPLE 11

According to this example, the method of Example 1 is repeated with the exception that 10 parts of lecithin is substituted for the 3 parts of MYVACET. Improved fibers and films are obtained thereby which have at least 15% greater physical properties.

EXAMPLE 12

According to this example, the method of Example 2 is repeated but 4 parts of stearyl acetate are substituted for the 4 parts of glycerol monooleate. It is expected that this solution does not exhibit significant advantages compared with that of Example 2 showing that esters with molecular weights below about 340 do not provide significant advantages.

Numerous modifications and variations in the practice of the invention are expected to occur to those skilled in the art upon consideration of the foregoing description on the presently preferred embodiments thereof. Consequently the only limitations which should be placed upon the scope of the present invention are those that appear in the appended claims.

What is claimed is:

1. In a process for precipitating cellulose from a solution thereof which comprises dissolving cellulose in a solvent for the cellulose containing a cyclic tertiary amine oxide and thereafter shaping the solution and separating the cellulose from the cyclic tertiary amine oxide, the improvement wherein the solution comprises an ester selected from the group consisting of mono-, di- and multiple esters having less than 10% solubility in water at 25° C. in an amount sufficient to retard precipitation of the cellulose during separation of the cellulose from the tertiary amine oxide.

2. The process of claim 1 wherein the cyclic tertiary amine oxide is N-methyl morpholine N-oxide (NMMO).

3. The process of claim 1 wherein the precipitation takes place in an aqueous system precipitation bath.

4. The process of claim 1 wherein the solution is substantially free of an organic cosolvent for the ester.

5. The process of claim 1 wherein the ester has a molecular weight greater than 340.

6. The process of claim 1 wherein the ester is present in amounts less than 25% by weight.

7. The process of claim 1 wherein the ester is present in amounts less than 10% by weight.

8. The process of claim 1 wherein the ester is an acetylated glycerol fatty ester.

9. The process of claim 1 wherein the ester is an esterified polyoxyethylene glycol.

10. The process of claim 1 wherein the ester is a glycerol diester.

11. The process of claim 1 wherein the ester is a fully esterified sucrose ester.

12. The process of claim 1 wherein the ester is polyvinyl acetate having at least 25% remaining acetate groups.

13. The process of claim 1 wherein the ester is lecithin.

14. The process of claim 2 wherein the solution comprises from about 8% to about 22% water.

15. The process of claim 2 wherein the solution comprises from about 5% to about 35% cellulose; and from about 2% to about 30% of a di-, tri, and multiple ester having a molecular weight of more than 340 dissolved in a solvent of NMMO/water having from about 8% to about 22% water.

16. The process of claim 1 wherein the cellulose is precipitated to form a fiber.

17. The process of claim 1 wherein the cellulose is precipitated to form a film.

18. The process of claim 1 wherein the cyclic tertiary amine oxide is selected from the group consisting of N-methylpiperidine-N-oxide, N-methylhomopiperidine oxide, N-dimethylcyclohexylamine oxide, N, N-dimethybenzylamine oxide, N-methylpyrrolidone-oxide, and N-methyl morpholine N-oxide.

* * * * *